US005458531A

United States Patent [19]

Matsuoka et al.

[11] Patent Number: 5,458,531

[45] Date of Patent: Oct. 17, 1995

[54] POLISHER

[75] Inventors: Yoshihiro Matsuoka, Chiba; Nobutoshi Takeda, Funabashi; Tohru Mizuhashi, Chiba, all of Japan

[73] Assignees: Emit Seikoco., Ltd.; Daito Seiki Co., Ltd., both of Tokyo, Japan

[21] Appl. No.: 200,733

[22] Filed: Feb. 23, 1994

[51] Int. Cl.[6] ..... B24B 7/00

[52] U.S. Cl. ..... 451/259; 451/270; 451/271

[58] Field of Search ..... 451/259, 270, 451/271, 283, 291, 288

[56] References Cited

U.S. PATENT DOCUMENTS

| | | | |
|---|---|---|---|
| 4,839,993 | 6/1989 | Masuko et al. | 451/283 |
| 4,979,334 | 12/1990 | Takahashi | 451/271 |
| 5,184,433 | 2/1993 | Maack | 451/270 |
| 5,351,445 | 10/1994 | Takahashi | 451/271 |

FOREIGN PATENT DOCUMENTS

| | | |
|---|---|---|
| 2158750 | 11/1985 | United Kingdom . |
| 2069381 | 8/1991 | United Kingdom . |

OTHER PUBLICATIONS

Patent Abstracts of Japan, vol. 11, No. 196 (M–601) Jun. 24, 1987 & JP–A–62 019 365 (Enshu Ltd.), Jan. 28, 1987.

*Primary Examiner*—Bruce M. Kisliuk

*Assistant Examiner*—Derris Banks

*Attorney, Agent, or Firm*—Frishauf, Holtz, Goodman, Langer & Chick

[57] ABSTRACT

An optical connector tip polisher which comprises a stationary block for supporting a wheel spindle stock, a manual slider for supporting an optical connector and a cam mechanism. The stationary block has a base for mounting the wheel spindle. The base has a guide space and a guide opening. The manual slider has a horizontal stock, a post and is a holder. The horizontal stock is fitted in the guide space of the base and restricted against movement in the vertical direction while being movable along a horizontal plane. The post is embedded in the horizontal stock and is movable in unison therewith. The post extends upright through the guide opening of the base. An idling wheel is provided between the inner periphery of the guide opening and the outer periphery of the post to guide the post along the inner periphery. The holder is secured to the post at an intermediate position thereof and holds an optical connector to perpendicularly press the tip of the optical connector against the wheel spindle stock.

10 Claims, 4 Drawing Sheets

POLISHER

FIELD OF THE INVENTION AND RELATED ART STATEMENT

This invention relates to a polisher for machining the top of an optical communication connector member commonly called a ferrule and, more particularly, to a manual optical connector tip polisher.

Among prior art methods of optical connector tip polishing are those of manual type and those of automatic type using machines. The manual type is convenient and does not require any power source, and thus it is adopted for on-site operations and operations in experimental rooms. The prior art manual optical connector tip polisher and the method of polishing with this polisher will now be described with reference to FIG. 5. An optical connector 101 as a workpiece is mounted in a holder 102 in a state that its tip projects from the holder. With the holder 102 held by the operator, the pressure P is applied to the surface of a polishing sheet 103 while moving the holder such as to draw a figure eight in plan view. In this way, the tip of the optical connector 101 is convex spherical polished.

To suppress the loss of coupling of the optical connector, the polished convex spherical surface has to be precisely symmetrical with respect to the optical axis of the optical connector. Generally, the allowance of the symmetricity is about 50 microns. However, in the manual polishing shown in FIG. 5 it is difficult to hold the holder 102 parallel to the polishing sheet 103 at all times, and during the polishing operation the optical axis of the optical connector is tilted irregularly. Therefore, the desired convex spherical surface axis symmetry can not be obtained.

OBJECT AND SUMMARY OF THE INVENTION

In the light of the above technical problems in the prior art, it is an object of the invention to provide a manual optical connector tip polisher, which can realize precise line symmetry.

To attain the above object of the invention, there is basically proposed a polisher, which comprises a stationary member having a wheel spindle stock, a slider having a holder for holding an optical connector and perpendicularly pressing the tip of the optical connector against the wheel spindle stock, the slider being movable in the horizontal direction, and a cam mechanism means for converting the motion of the slider into a motion in a predetermined direction when a force in a given direction is applied to the slider.

In the above basic structure of the polisher, the cam mechanism means may have a structure of undergoing a circular motion. Further, the cam mechanism means may have an inner periphery of a circular opening, an outer periphery of a member with an external force applied thereto, and a gap restriction member disposed between the inner and outer peripheries.

According to the invention, there is further provided a polisher which comprises a stationary block having a guide space, a guide opening having a predetermined shape and a base for mounting a wheel spindle stock thereon; a slider including a horizontal stock disposed in the guide space and movable in the horizontal direction according to an input in a given direction, a post disposed in the guide opening and integral with the horizontal stock, the post being movable with a movement of the horizontal stock, and a holder mounted on the post such as to hold an optical connector and perpendicularly press the tip thereof against the wheel spindle stock; and a cam mechanism for converting the movement of the post into a movement along a predetermined shape of the guide opening.

In the above specific structure of the polisher according to the invention, the cam mechanism means may have a structure of undergoing a circular motion. Also, the cam mechanism may include the inner periphery of the guide opening, the outer periphery of the post and a gap restriction member disposed between the inner and outer peripheries. Further, the wheel spindle stock may have a central opening substantially matched to the guide opening. Further, the above specific structure of the polisher according to the invention may further comprise friction provision means for causing the wheel spindle stock to be rotated by the friction between the wheel spindle stock and the post when an external force is applied to the post. The friction provision means may be a rubber ring provided on the inner periphery of the wheel spindle stock. Further, in the above specific structure of the plisher according to the invention, the wheel spindle stock may have an elastically deformable polishing sheet provided on a portion contacted by the optical connector tip. Further, the holder is mounted on the post such as to be capable of position adjustment. Further, the holder may have a plurality of chucks for respective optical connectors having different shapes. Further, the post may be embedded in the horizontal stock such as to have an upright posture.

The operation according to the invention will now be described. It is now assumed that an external force F is manually applied to the center of the post 11. The external force F has a given direction, and it is disassembled into a radial component FR directed along the rotational line D and a circumferential component FC perpendicular to the component FR. The radial component FR is canceled by counter force received from the idling wheel. The circumferential component FC, on the other hand, has an effective action to cause circular motion or revolution of the post about the center 0 in the clockwise direction. When the manually applied external force F perfectly coincides with the direction of the rotational line D, no torque is obtained. However, the operator can sense the counter force, and thus it is readily possible to start the revolution of the post by changing the direction of the external force F.

Once the revolution is caused, the external force F is applied such as to continue the revolution. It is readily possible to reverse the rotation of revolution, if desired. The circular motion of the post causes following rotation of the rotational line D to cause an interlocked motion of the idling wheel.

As will be seen, according to the invention use is made of a cam mechanism, which can convert the movement of the post into a movement along a predetermined shape of the opening noted above. The stationary block has the base having the guide space and the guide opening. On the other hand, the slider has the horizontal stock, the post and the idling wheel. The horizontal stock is fitted in the guide space of the base and restricted against movement in the vertical direction, while it is movable along the horizontal plane according to an input in any direction. The post is embedded in the horizontal stock and is movable in unison therewith. It extends upright through the guide opening of the base. The idling wheel, which is provided between the inner periphery of the guide opening and the outer periphery of the post, converts the movement of the post into a circular motion along the inner periphery.

DETAILED DESCRIPTION OF THE PREFERRED EMBODIMENTS

Figure 1:
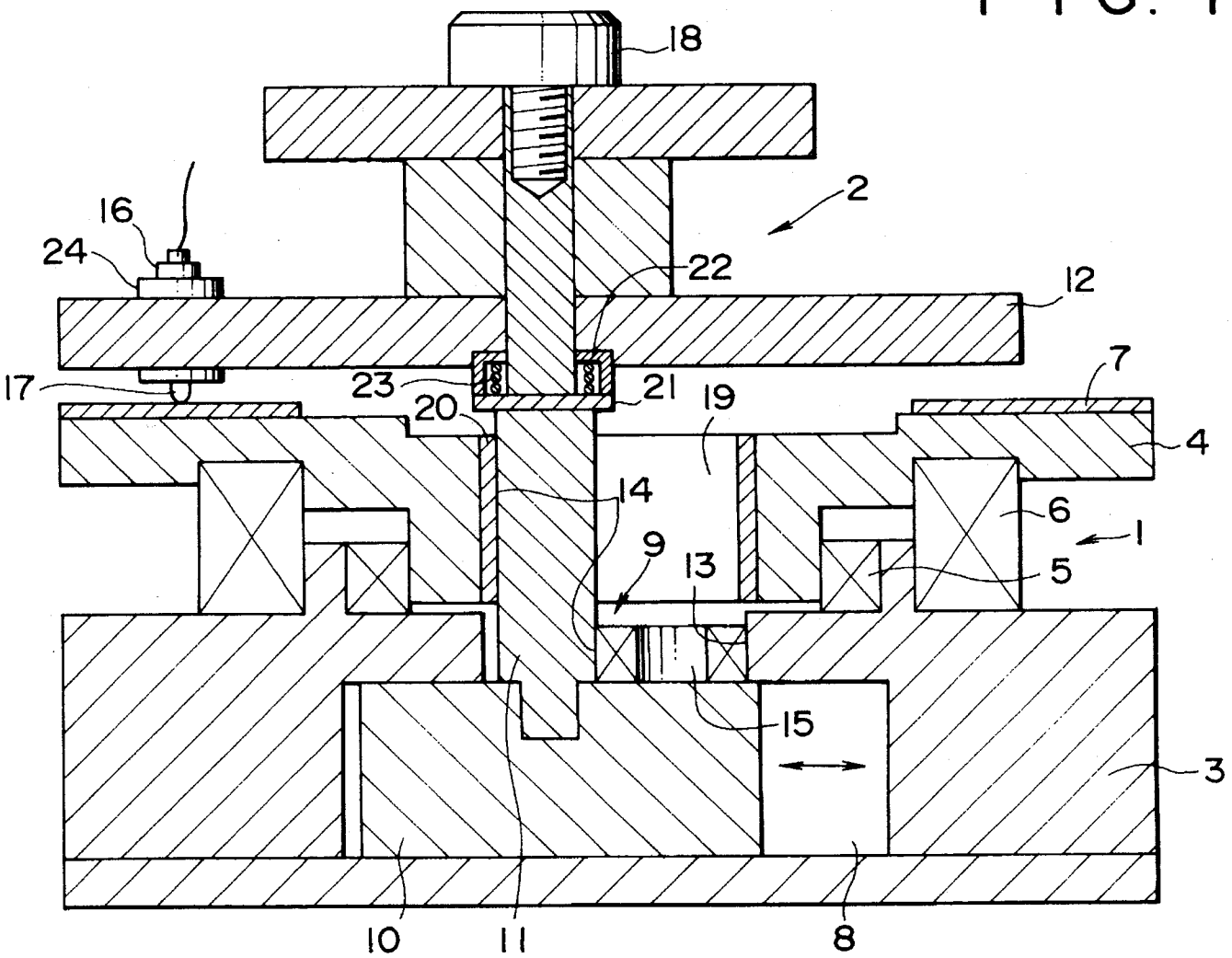
FIG. 1 is a schematic sectional view showing an optical connector tip polisher according to the invention.

A preferred embodiment of the invention will now be described in detail with reference to the drawings. FIG. 1 is a sectional view showing an optical connector tip polisher according to the invention. The optical connector tip polisher comprises a block-slider assembly including a stationary block 1 and a manual slider 2 and also a cam mechanism. The stationary block 1 includes a base 3 and a wheel spindle stock 4. The wheel spindle stock 4 is rotatably mounted on the base 3 via a radial and a thrust bearing 5 and 6. While in this embodiment both the radial and thrust bearings 5 and 6 are used, this is by no means limitative, that is, it is possible to use only one of the two bearings. Further, while the wheel spindle stock 4 is rotatably mounted, this is again not limitative, and it may be secured. The wheel spindle stock 4 has a precisely parallel surface with an elastically deformable polishing sheet 7 applied thereto. The elastically deformable polishing sheet is useful when polishing a spherical surface of the optical connector tip. However, for flat surface polishing this type of polishing sheet need not be used. The base 3 has a guide space 8 and a guide opening 9. The guide opening 9 is in communication with the guide space 8. It is circular in shape, and its center is aligned with the axis of rotation of the wheel spindle stock 4.

The manual slider 2 includes a horizontal stock 10, a post 11 and a holder 12. The horizontal stock 10 is accommodated in the guide space 8 of the base 3. It is restricted against its movement in the vertical direction, but it is freely movable along the horizontal plane as shown by arrow. The post 1 is embedded in the horizontal stock and movable in unison therewith. It extends upright through the guide opening 9 of the base 3. Between the inner periphery 13 of the guide opening 9 and the outer periphery 14 of the post 11, an idling wheel 15 is disposed to restrict the play. The idling wheel 15 has a function of guiding the post 11 along the inner periphery surface 13 of the guide opening 9. In other words, the post 11 revolves around the center of the post 11. For permitting the revolution smoothly and removing friction, the idling wheel 15 has a bearing. However, it is not essential to use a bearing wheel, but it is possible to use a less frictional metal disk. The holder 12 is secured to the post 11 at an intermediate position thereof, and extends parallel to the wheel spindle stock 4 and faces the same at a predetermined gap. The holder 12 vertically holds an optical connector 16 as work, and vertically presses the tip 17 thereof against the polishing sheet 7 applied to the wheel spindle stock 7. The holder 12 is mounted on a top of the post 11 by a bolt 18. The slider 2 is driven by manually moving the top of the post 11.

Suitably, the wheel spindle stock 4 has a central opening 19 which is substantially aligned to the guide opening 9 of the base 3. A rubber ring 20 is fitted in the inner periphery of the central opening 19, and it is in contact with the outer periphery 14 of the post 11. Thus, with the revolution of the post 11 the wheel spindle stock 4 is rotated in frictional contact with the post 11. To permit this following rotation smoothly, a slight play is suitably provided between the outer periphery 14 of the post 11 and the rubber ring 20. Likewise, for the smooth revolution of the post 11 a predetermined play is suitably provided between the inner periphery 13 of the guide opening 9 and the outer periphery 14 of the post 11. In this embodiment, the outer periphery 14 of the post is machined to a cylindrical form. However, this is by no means limitative; for example, it may be machined to an elliptical cylindrical form to permit intermittent contact with the rubber ring 20, thus providing versatility to the rotational motion of the wheel spindle stock 4.

Further, in addition to the rubber ring 20, the post may be provided with an elastic projection to be in contact with the inner periphery of the central opening.

As noted above, the wheel spindle stock 4 has the polishing sheet 7 which is elastically deformable for precise spherical polishing of the optical connector tip 17 which is pressed vertically. To this end, the holder 12 is mounted on the post 11 such that its position is adjustable therealong for suitably setting the extent of press wedging of the optical connector tip 17 in the polishing sheet 7. Specifically, an adjusting ring 22 is provided between a flange 21 provided on the post 11 at an intermediate position thereof and the bottom of the holder 12. The adjusting ring 22 is replaceable, and it is thus possible to suitably set an appropriate gap between the bottom of the holder 12 and the surface of the polishing sheet by selecting the adjusting ring 22 having a desired height dimension. Inside the adjusting ring 22, a coil spring 23 is provided to obtain a predetermined force of forced contact. Suitably, the holder 12 has a plurality of chucks 24 provided at an interval in the circumferential direction (only one of the chucks being shown). The plurality of chucks 24 correspond to optical connectors 16 having different shapes, and thus it is possible to polish different kinds of optical connectors 16.

Figure 2A:
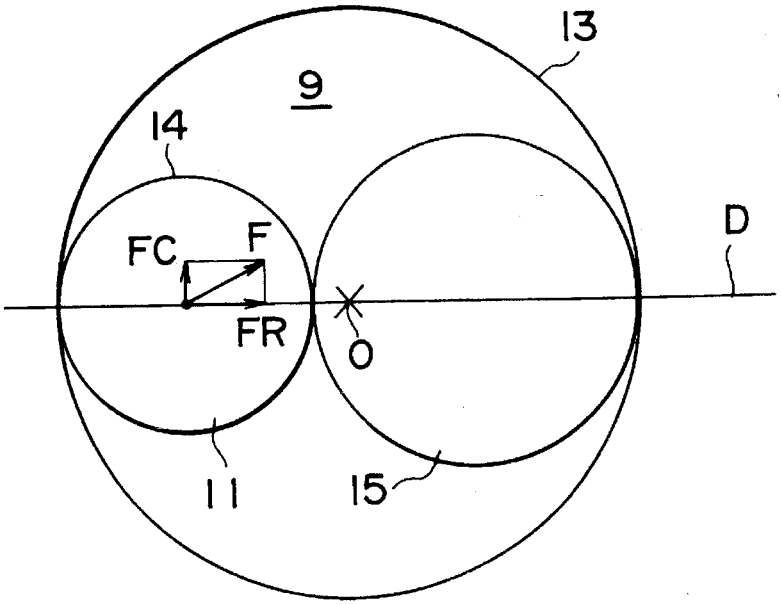
FIGS. 2A and 2B are views for explaining the operation of the optical connector tip polisher shown in FIG. 1.
Figure 2B:
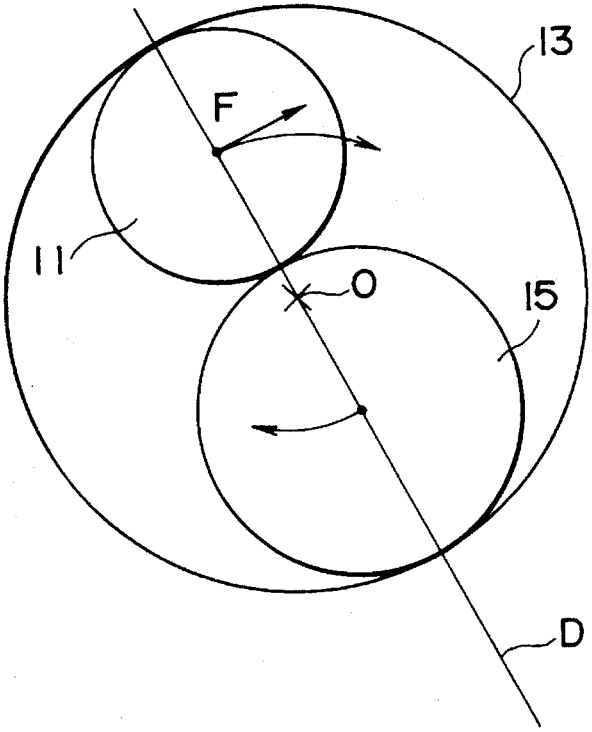

Now, the operation of the optical connector tip polisher according to the invention will be described in detail. FIGS. 2A and 2B are schematic plan views showing the positional relationship among the post 11, guide opening 9 and idling wheel 15. FIG. 2A shows a state at the time of the start, and FIG. 2B shows a state of continuous operation. In the initial state shown in FIG. 2A, the post 11 and idling wheel 15 are stationary in an aligned state along a rotatable line D passing through the center 0 of the guide opening 9. The center 0 of the guide opening 9 coincides with the axis of rotation of the wheel spindle stock. For smooth movement of the post 11, it is suitable to provide slight plays between the outer periphery 14 of the post 11, the inner periphery 13 of the guide opening 9 and the outer periphery of the idling wheel 15. It is now assumed that an external force F is manually applied to the center of the post 11. This external force F has a given direction, and it is disassembled into a radial component FR directed along the rotational line D and a circumferential component FC which is perpendicular to the component FR. The radial component FR is canceled by receiving a counter force from the idling wheel 15. The circumferential component FC, on the other hand, has an effective action, and in the illustrated example the post 11 is caused to undergo a circular motion or revolution about the center 0. When the manually applied external force F perfectly coincides with the direction of the rotational line D, no rotational force is obtained. However, the operator can sense the counter force, and thus it is readily possible to start the revolution of the post 11 by changing the direction of the external force F.

Once the revolution is started, external force F is applied continuously to continue the revolution as shown in FIG. 2B. It is thus possible to realize smooth revolution. It is further readily possible to reverse the direction of the revolution, if desired. When the post 11 is caused to undergo circular motion, the rotational line D is rotated with this motion, thus causing an interlocked motion of the idling wheel 15.

In the above case, the slider is rotated manually, but it is possible to obtain the same action by mechanically causing the motion.

As is seen from the above explanation, according to the invention use is made of the cam mechanism, which converts an input in a given direction into a circular motion in a predetermined direction. The cam mechanism has a structure for converting the motion of the post 11 into a motion brought about along a predetermined shape of the guide opening 9. More specifically, the stationary block 1 has the guide space 8 and the base 3 with the guide opening 9 formed therein. Meanwhile, the slider 2 is provided with the horizontal stock 10, the post 11 and the idling wheel 15. The horizontal stock 10 is accommodated in the guide space 8 of the base 3 and restricted against movement in the vertical direction. It is movable, however, along the horizontal plane according to an input in a given direction. The post 11 is embedded in the horizontal stock 10 and movable in unison therewith. It extends upright through the guide opening 9 of the base 3. The idling wheel 15 is present between the inner periphery 13 of the guide opening 9 and the outer periphery 14 of the post 11 and converts the movement of the post 11 into a circular motion along the inner periphery 13.

Figure 3:
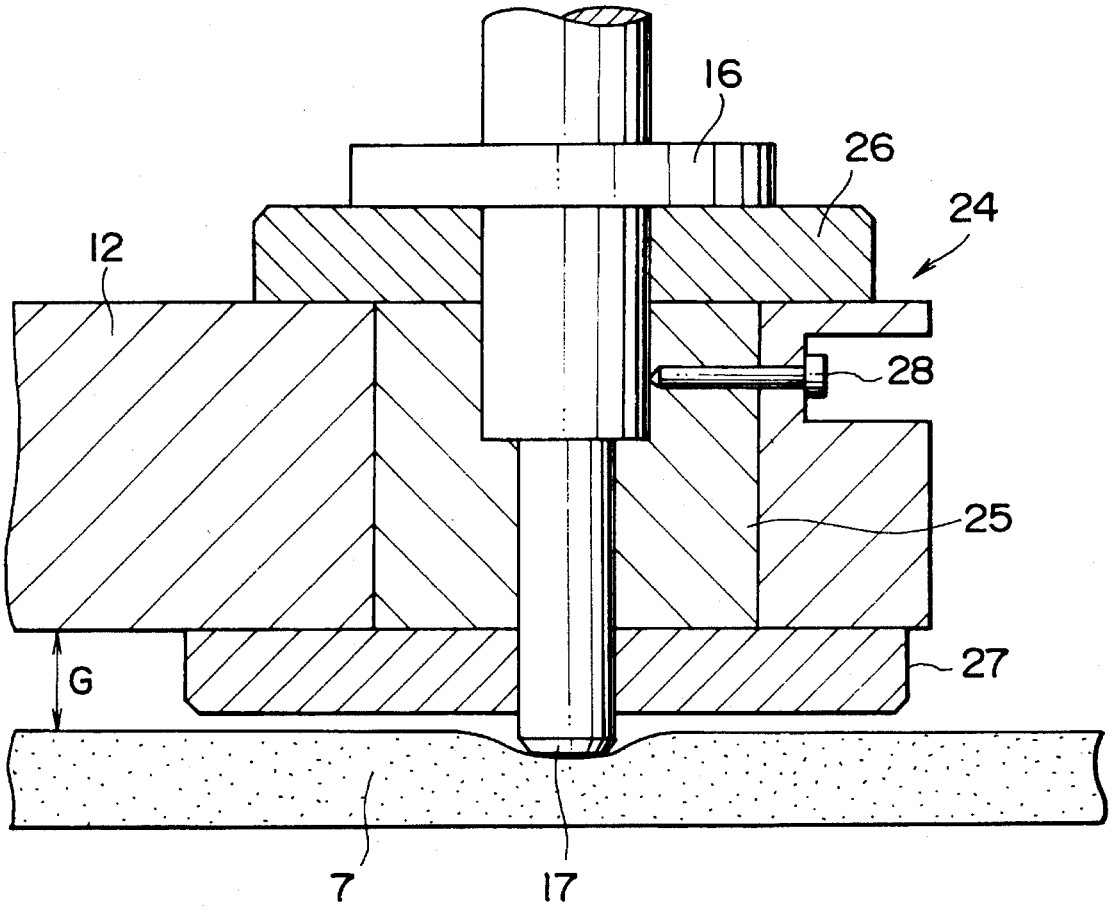
FIG. 3 is also a view for explaining the operation of the optical connector tip polisher.

The operation of the manual optical connector tip polisher according to the invention will now be described continually with reference to FIG. 3. FIG. 3 is a fragmentary sectional view, to an enlarged scale, showing the chuck 24. In this example, the chuck 24 comprises a bush 25 which is embedded in the holder 12. Metal spacers 26 and 27 are secured to the upper and lower surfaces of the bush 25. The guide bush 25 guides, positions and secures the optical connector 16 inserted into it. In this example, the connector 16 is of ferrule type, and the chuck 24 is designed in conformity to this. The tip 17 of the ferrule 16 projects from the lower metal spacer 27 and is pressed against the polishing sheet 7. The polishing sheet 7 undergoes elastic deformation, and convex spherical polishing of the tip 17 can be done by moving the holder 12 with the manual slider 2. While the manual slider 2 is driven, the post 11 accurately holds its upright posture. Thus, the optical axis of the optical connector 16 held in the chuck 24 is not tilted, and thus it is possible to obtain convex spherical polishing with very excellent symmetricity. As noted before, the gap G between the holder 12 and the polishing sheet 7 is suitable adjustable. Thus, it is possible to set a desired radius of the convex spherical surface of polishing by appropriately selecting the extent of wedging of the optical connector tip 17.

Figure 4:
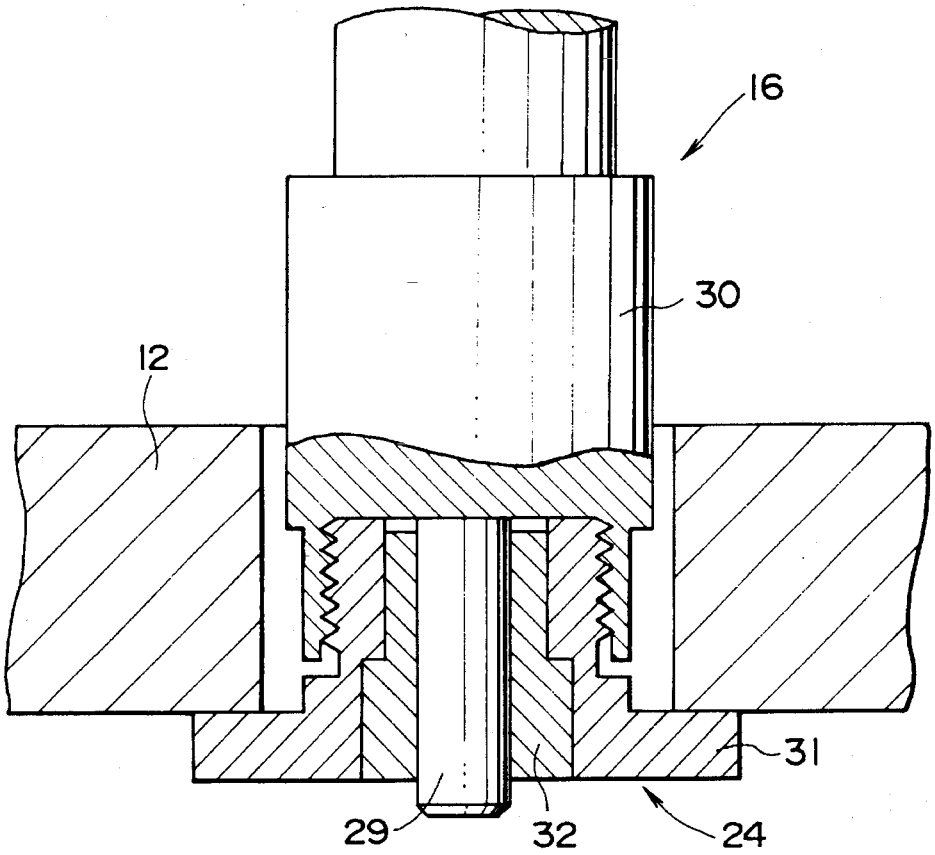
FIG. 4 is a schematic fragmentary sectional view showing a different example of a chuck that is assembled in a holder of the optical connector tip polisher.
Figure 5:
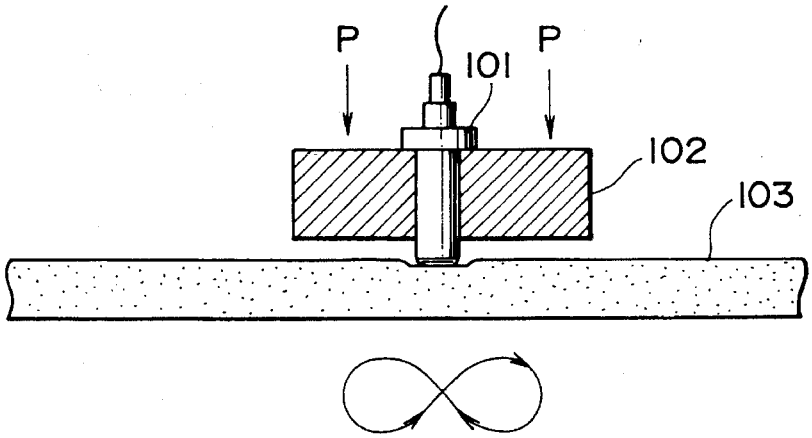
FIG. 5 PRIOR ART
FIG. 5 is a view for explaining a prior art method of manually polishing the optical connector tip.

FIG. 4 shows a different example of chuck 24 which is provided on the same holder. This chuck 24 is used to mount an optical connector 16, in which a ferrule 29 and an adapter 30 are integral. The chuck 24 comprises a receptacle 31 mounted on the holder 12. In the receptacle 31, a bush 32 is fitted for guiding the ferrule 29. The adapter 30 of the optical connector 16 is mounted in the holder 12 such that it is engaged with the receptacle 31.

As has been described in the foregoing, the optical connector tip polisher according to the invention comprises a stationary block, a slider and a cam mechanism for converting an input in a given direction into a circular motion. Thus, it is possible to make effective use of manual input and obtain very efficient polishing of the optical connector tip. Further, with the provision of the holder for the post of the slider, the optical axis of the optical connector can be held upright with respect to the polishing surface at all times to permit convex spherical polishing with excellent symmetricity. Further, since the mounting height of the holder with respect to the wheel spindle stock is adjustable, it is possible to select a desired radius of the convex spherical surface of plishing. Further, with the provision of different kinds of chucks on the holder, it is possible to polish optical connectors having a variety of shapes. Further, with the structure, in which the wheel spindle stock is turned to follow the circular motion of the slider, it is possible to obtain more efficient polishing.

What is claimed is:

1. A polisher comprising:

(a) a stationary block having a guide space, a guide opening having a predetermined shape and a base for mounting a wheel spindle stock thereon;

(b) a slider including:

a horizontal stock disposed in said guide space and movable in the horizontal direction according to an input in a given direction;

a post disposed in said guide opening and integral with said horizontal stock, said post being movable with a movement of said horizontal stock; and a holder mounted on said post so as to hold an optical connector and perpendicularly press a tip of the optical connector against said wheel spindle stock; and (c) a cam mechanism arranged to convert the movement of said post into a movement along the predetermined shape of said guide opening.

2. The polisher according to claim 1, wherein said cam mechanism has a structure to convert an input in a given direction into a circular motion.

3. The polisher according to claim 2, wherein said cam mechanism includes an inner periphery of said guide opening, an outer periphery of said post and a gap restriction member disposed between said inner and outer peripheries.

4. The polisher according to claim 1, wherein said wheel spindle stock has a central opening substantially matched in shape to said guide opening.

5. The polisher according to claim 1, which further comprises friction provision means for causing said wheel spindle stock to be rotated by friction between said wheel spindle stock and said post when an external force is applied to said post.

6. The polisher according to claim 5, wherein said friction provision means comprises a rubber ring provided on an inner periphery of said wheel spindle stock.

7. The polisher according to claim 1, wherein said wheel spindle stock has an elastically deformable polishing sheet provided on a portion which is contacted by the optical connector tip.

8. The polisher according to claim 1, wherein said holder is adjustably mounted on said post such that the position of said holder is adjustable.

9. The polisher according to claim 1, wherein said holder has a plurality of chucks for holding respective optical connectors having different shapes.

10. The polisher according to claim 1, wherein said post is embedded in said horizontal stock so as to have an upright posture.

* * * * *